US006108942A

United States Patent [19]

Fezer

[11] Patent Number: 6,108,942

[45] Date of Patent: Aug. 29, 2000

[54] OPPOSED BELT DRYING APPARATUS FOR SLICED WOOD VENEERS

[75] Inventor: Carlos Alberto Fernando Fezer, Caçador, Brazil

[73] Assignee: Fezer S.A. Industrias Mecanicas, Cacador, Brazil

[21] Appl. No.: 09/119,414

[22] Filed: Jul. 20, 1998

[51] Int. Cl.[7] ..... F26B 21/06

[52] U.S. Cl. ..... 34/636; 34/647; 34/649; 34/651

[58] Field of Search ..... 34/207, 208, 236, 34/611, 616, 620, 638, 636, 114, 116, 627, 647, 649, 651

[56] References Cited

U.S. PATENT DOCUMENTS

| | | | |
|---|---|---|---|
| 3,334,421 | 8/1967 | Morris | 34/205 |
| 4,045,262 | 8/1977 | Enzinger et al. | 156/62.2 |
| 4,417,406 | 11/1983 | Eibich | 34/155 |
| 4,654,981 | 4/1987 | Grebe et al. | 34/114 |
| 4,862,600 | 9/1989 | Cremona | 34/117 |
| 5,226,243 | 7/1993 | Cremona | 34/116 |

FOREIGN PATENT DOCUMENTS

| | | |
|---|---|---|
| 1266233 | 4/1968 | Germany . |

*Primary Examiner*—Pamela A. Wilson
*Assistant Examiner*—Michelle A. Mattera
*Attorney, Agent, or Firm*—Hodgson, Russ, Andrews, Woods & Goodyear, LLP

[57] ABSTRACT

A drying apparatus for sliced veneer sheets having a conveying system comprising two superposed conveyor belts lying one above the other which are guided over a drying path around guide members. The drying path includes both rectilinear and curvilinear sections and includes a three roller configuration for making a one hundred eighty degree turn in the drying path. The drying path is designed to provide for pressing of the veneer and to allow for the effects of shrinking of the veneer during the drying process.

1 Claim, 2 Drawing Sheets

OPPOSED BELT DRYING APPARATUS FOR SLICED WOOD VENEERS

FIELD OF THE INVENTION

The present invention relates to an apparatus for the drying of sheets of sliced veneer and, more particularly, to an opposed belt drying system to promote the drying of veneer sheets free from crack formation.

BACKGROUND OF THE INVENTION

Veneer is a layer of wood of superior value or excellent grain for overlaying an inferior wood. Veneer is usually formed from a thin sheet of wood that is cut or sawed from a log and is adapted for adherence to a smooth surface. Sheets of veneer are extremely thin (usually 0.5 to 0.7 mm in thickness). The length of the veneer sheets is typically in the range of 2.2–5.2 m. The width of the sheet of veneer can range from 200 to 1000 mm. These "raw" sheets of veneer contain moisture which must be removed by a drying process prior to lacquering or other laminating processes. The drying process normally includes applying heat and pressure to the veneer inside a temperature and humidity controlled dryer as is known to persons of ordinary skill in the art.

Moving the sheets of veneer through the dryer during the drying process is a delicate operation because the wet veneer sheets lack sufficient weight or rigidity to be moved easily in conveying systems. Also, the veneer shrinks during the drying process. If the sheet is being held firmly while it is trying to shrink, the resulting stresses can cause cracking or microfissures. Microfissures cause the surface porosity of the veneers to vary, thus creating problems in the subsequent laminating operations.

There are two principal methods for conveying sheets of veneer through dryers. The first method involves roller-type systems that pass the veneer sheets through successive pairs of opposed pressure rollers. The roller-type systems convey the sheets of veneer along the drying path and have a pressing effect that flattens and smooths out the surface of the veneer sheets. However, these systems have some drawbacks, including the fact that the elevated pressures associated with these type systems are often unsuitable for the treatment of some woods.

The disadvantages are especially serious for sensitive and highly valuable thin veneers. Veneer requires a certain amount of rigidity to be fed from roller pair to roller pair. This rigidity is not available in most thin or moist veneer. Accordingly, the roller systems have to have positive traction on the veneer by means of the rollers at all times. This traction does not adequately accommodate shrinking.

The second type of conveying system for thin veneers is the overlaid belt type systems. In these systems, a pair of endless belts are driven by guide rollers. The sheet of veneer is carried between the belts. The belts are usually manufactured out of a mesh material to allow the drying air inside the dryer to reach the surface of the material.

Some of the belt type systems convey the sheets of veneer through the dryer in a simple rectilinear path. Although this type of belt arrangement allows the sheets to shrink during drying, they typically do not provide a sufficient pressing effect. According to the particular form of the belts (for example wire netting), a smoothing effect caused by the weight of the upper or covering belt may occur. However, this smoothing effect is not sufficient in prior art belt drying processes to prevent the appearance of wavelike imperfections on the product during drying. Accordingly, the main advantages to simple rectilinear belt dryers are that it is possible to shrink the veneer between the belts to avoid crack formation and that the systems are capable of feeding thin, moist veneer. However, the weight of the covering belt is generally not sufficient to smooth the veneer satisfactorily. Accordingly, the veneer will usually have to be dried in belt dryers and then smoothed in a smoothing press in order to remove the imperfections.

In order to provide better flattening of the sheets, a drying system having a belt conveying system arranged in a sinusoidal path is described and illustrated in German patent No. 1266233. The belts are guided on a curved, looped path around staggered rollers. The sheet to be dried is entrained between two endless smooth wire fabric belts, which are passed zig-zag-wise in a controllable arrangement about the rollers with an elevated belt tension. As a result of the sinusoidal path, the belts are able to bring a flattening pressure onto the veneers. However, such pressure is continuous throughout the drying cycle and does not adequately compensate for shrinking. In order to maintain the pressure, the sheets are required at almost every instant to follow a curvilinear path during which they are practically always in contact with the guide rollers. As a result, the veneers are not permitted to shrink freely without risk of causing flaws or cracks.

U.S. Pat. No. 4,654,981 discloses an improvement in the opposed belt, sinusoidal drying path system wherein between one guide roller and the next (the axes of rotation of which are all in one plane) there is a rectilinear section having a length equal to at least one-half of the maximum width of the veneer sheets. Although the rectilinear sections provide for shrinking, the curvilinear sections created by the large guide rollers create pressures on the veneer sheets that are too great for certain very thin, superior wood veneers and can cause microfissures. Also, the arrangement of the guide rollers in the same plane presents a problem with mounting nozzles for blowing warm air directly onto the veneers contained inside the belts. Accordingly, the drying process has to be lengthy or the rollers have to be equipped with costly heating elements.

Another improvement over the opposed belt sinusoidal drying path system is disclosed in U.S. Pat. No. 4,862,600. This patent discloses a drying path wherein the guide rollers are smaller and are positioned in a sinusoidal path instead of being all in the same plane. A plurality of rectilinear sections are disposed between the guide rollers, and a curvilinear section is disposed along each roller. However, due to the orientation of the guide rollers the belts only wrap around the primary roller in the curvilinear section for an angle of approximately 40 to 50 degrees of rotation. The problem with conveying the sheets of veneer in this manner is that it would be exceedingly difficult to stretch a metallic belt under the required tension around so many small rolls. The rolls would not be able to withstand the load.

What is needed is a drying system with a drying path that does not cause cracking or microfissures on the surface of the veneer, that provides for pressing of the veneer to remove surface imperfections, and that is suitable for drying and conveying very thin, delicate and lightweight veneers.

SUMMARY OF THE INVENTION

The present invention solves the problems described above by providing a drying apparatus for sliced veneer sheets with a conveying system comprising two superposed conveyor belts lying one above the other which are guided over a drying path around guide members, for example, drums, cylinders or rollers that can rotate about their respective axes along the drying path. The path can include a plurality of drying zones assembled from modular units.

The sliced veneer sheets are placed between perforate or openwork (wire-screen) belts which hold and carry the sheets to an intake area or zone and then transport the sheets into a preferably ventilated drying chamber. The dried sliced veneer is recovered from the belts after drying in an output area or zone.

According to the invention the conveyor belts run both rectilinearly and curvilinearly. The rectilinear sections provide areas where each veneer sheet is free of applied pressure except for the weight of the upper belt. In this manner the veneer sheets are free to shrink so that the occurrence of cracks is avoided. The curvilinear sections occur where it is necessary to reverse the direction of the belts, and the change of direction is accomplished with three guide members arranged in a substantially triangular configuration. The use of three rollers allows the veneer some time between the rollers to shrink without tearing.

A velocity difference between the belts of 1% to 12%, preferably 2% to 5%, is found to lead to an improved product and help prevent cracking.

A significant rectilinear section (at least 20%) of the conveyor path before the first guide apparatus is reached, preferably 35% to 55% provides for excellent drying. It is advantageous to position this initial rectilinear section at the top of the drying chamber to take advantage of the better heating and ventilation at the top of the chamber compared to the bottom.

Heated air is preferably blown from radial fans through a plurality of nozzles disposed in jet boxes perpendicular to the conveyor belt. The jet boxes are preferably distributed along the length of the belts. In order to provide for uniform distribution of the heating air, the jet boxes are arranged to maintain an equal distance between the jet boxes and the veneer for uniform drying of the veneer.

The conveyor belt is constructed from a nonelastic material, preferably a woven metal fabric. A plurality of small holes in the belts facilitate contact of the drying or heating agent with the sliced veneer, while allowing pressure to be applied and providing a surface for smoothing. The belts or screens are tensioned by pneumatic cylinders.

The upper and lower belts are driven by separate electronically synchronized gearmotors that are driven by frequency inverters. The guide members can be attached to a chain drive for rotation. Other drive methods including cylindrical guide drums using smaller driven running rollers positioned along the peripheries of the larger guide drums may also be used.

The nozzles which are provided to treat the sheets with the heating and drying fluid, are directed substantially perpendicularly to the web, the nozzles being part of large manifolds or jet boxes.

Accordingly, it is an object of the invention to provide an improved drying apparatus for sliced veneer that produces a product that has a smooth, crack free surface.

DETAILED DESCRIPTION OF THE PREFERRED EMBODIMENT

Figure 1:
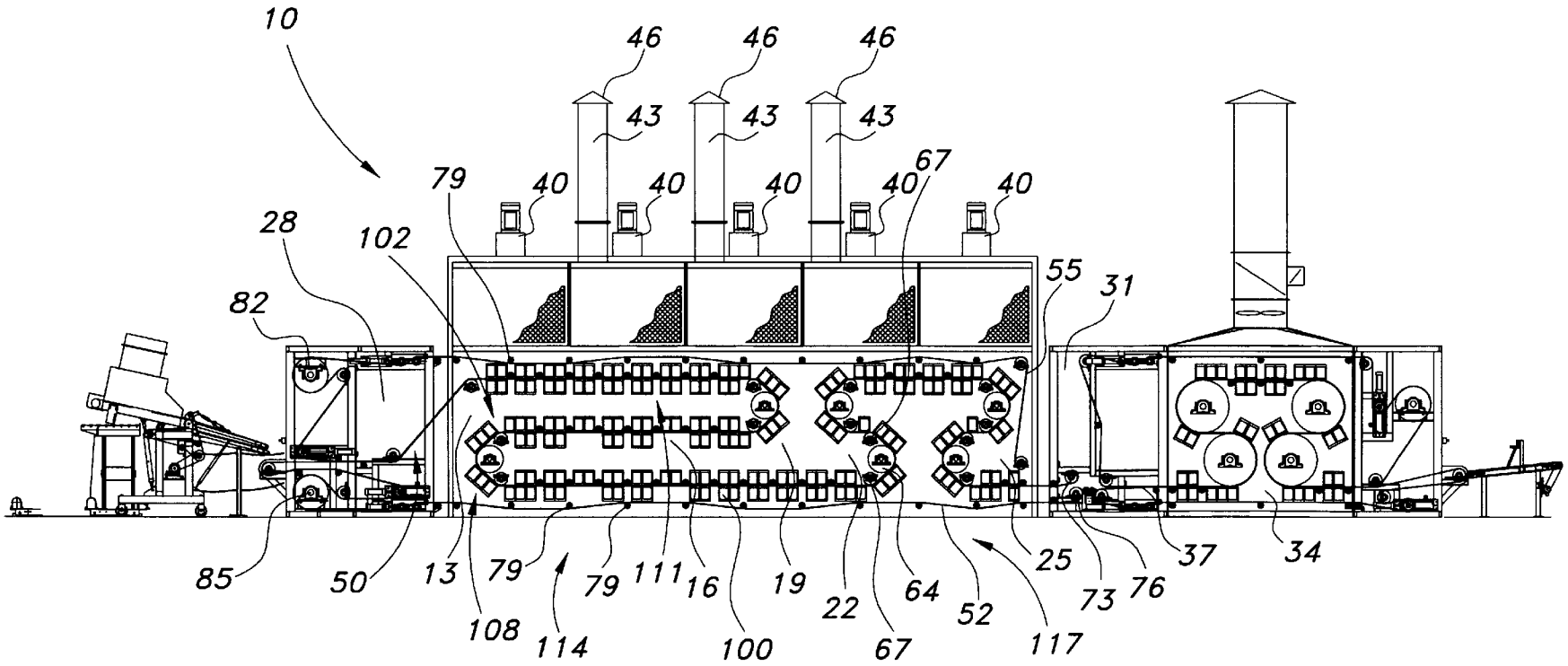
FIG. 1 is a longitudinal section illustrating a preferred embodiment of the drying apparatus of the present invention.

In FIG. 1, a sealed or generally closed drying chamber 10, is divided into a plurality of areas or zones 13, 16, 19, 22, and 25, preferably of a modular construction so that any number of zones can be assembled into a drying apparatus for a particular purpose. At the drying apparatus entrance an intake zone 28 is found. The final drying apparatus zone 25 is connected to an output zone 31. The output zone 31 is connected to a cooling zone 34 by means of a conveyor belt system 37. The sheets of sliced veneer can then proceed from the cooling zone 34 to other areas where further work is done (i.e., lamination may be carried out).

Each drying zone 13 to 25 has a radial fan 40 and a heat exchanger (not shown) with an adjustable heat supply; the heat supply utilizes burners, hot water, steam or the like. The radial fans 40 preferably have helical blades for high efficiency and low noise. The fans 40 provide for greater pressure stability when the air density and temperature change. Also, the radial fans 40 allow for attachment of the motors outside of the structure which provides for easier cooling for the motors. Furthermore the drying chamber 10 is provided with exhaust ports 43 that are connected to the chamber interior by way of a controllable outlet trapdoor or damper 46. The amount of water inside the drying chamber 10 is controlled by these valves which are automatically controlled by a unit that measures the moisture in each temperature zone. In this way the required drying climate may be maintained in each of the zones 13 to 25.

The sliced veneer is conveyed by a belt conveyor 50, which comprises two endless belts 52 and 55. The supporting belt 52 and the covering belt 55 are directly juxtaposed and are guided together rectilinearly through the first three zones 13 to 19. In zone 19 the belts are looped around the guide members 64 and 67 which are preferably comprised of rollers. Other guide members such as drums, cylinders and the like are also suitable. In the horizontal direction the sheets of sliced veneer are entrained by the belts in succession and enter the zone 19 from the zone 16 horizontally and pass over the guide members 64 and 67 to reverse direction.

The length of the entire joint conveyor segment in the drying apparatus in the particular embodiment shown amounts to somewhat more than 20 m.

In zone 31 the belts 52 and 55 are guided away from each other and fed back to the drying apparatus entrance supporter on guide members 73 and 76. The belts are guided with the aid of rollers 79 that are disposed throughout the drying chamber 10. Each belt 52 and 55 preferably runs through a tension regulator 82 and 85 respectively, with which the operating tension in the belts 82 and 85 is adjusted. The tension devices 82 and 85 each comprise a guide member whose position can be pneumatically altered.

The belts 52 and 55 are preferably made from a nonelastic material. It is possible that they have a fixed elasticity that will guarantee that they produce the desired applied pressure on the rollers and guide rollers by means of a suitable operating tension. They preferably have openings for the hot air, which are as small as possible, in order that the largest possible pressing surface be provided for the veneer. Further the belts are designed such that the sliced veneer sheets can slide to and fro thereon (and vice versa) without marking the veneer surface. Accordingly, flat spiral wound wire net belts or flat spiral woven wire belts (e.g. of round cross section wire) are preferred for the belts of this invention.

The belts 52 and 55 are driven by separate electronically synchronized gearmotors that are driven by frequency inverters. In operation a velocity difference of 2% is maintained between the belts 52 and 55 in this preferred embodiment, while velocity differences of from 1% to 12% may be used.

The belts can be driven by the guide members through connection to a motor in many ways such as by chain drives, belt drives, direct drives and the like as will be apparent to those of ordinary skill in the art.

In FIG. 1, in the drying chamber 10 a plurality of nozzles 94 (not shown) are provided in jet boxes 100 located along the joint conveyor segment. The jet boxes 100 are preferably constructed of galvanized sheet metal with a tapered design to keep the flow of air even through the nozzles 94. The distance between the jet boxes 100 is also important as more jet boxes 100 over a given drying length results in more nozzles and increased air delivery from the radial fans 40. The flow of air that is produced by the fans 40 is aerodynamically conveyed to the jet boxes 100 by means of deflecting plates (not shown) in order to avoid turbulence. The nozzles 94 provide hot air or other drying agents perpendicularly to the sliced veneer sheets. The jet boxes 100 are preferably positioned such that the jet boxes 100 are equidistant from the veneer sheets to provide uniform drying.

The nozzles 94 are arranged both above and below the supporting rollers along the drying path.

Sliced veneer sheets can be inserted into the drying apparatus individually at the intake zone 28. They lie between the support and covering belts 52 and 55 respectively, such that the weight of the covering belt 55 provides a certain smoothing effect. The weight of the covering belt 55 and the difference in belt velocities are such that the sheet veneer is not belt 55 provides a certain smoothing effect. The weight of the covering belt 55 and the difference in belt velocities are such that the sheet veneer is not prevented from shrinking during drying. On passage through the zones 13 to 25 the material will be predried with hot air from the adjacent nozzles 94. Preferably predrying will continue until the fiber saturation point is reached.

The outer belt 55 presses the veneer sheet against the inner belt 52 when the belts contact the guide members in the curvilinear section. As a result of this pressure, the sheet of veneer is smoothed.

The velocity difference between the belts 52 and 55 and the distribution of tension may be regulated through adjustment of the gear motors.

The veneer sheet leaves the drying chamber 10 from the output zone 31, from which it is carried to the cooling area 34 by the conveyor system.

Figure 2:
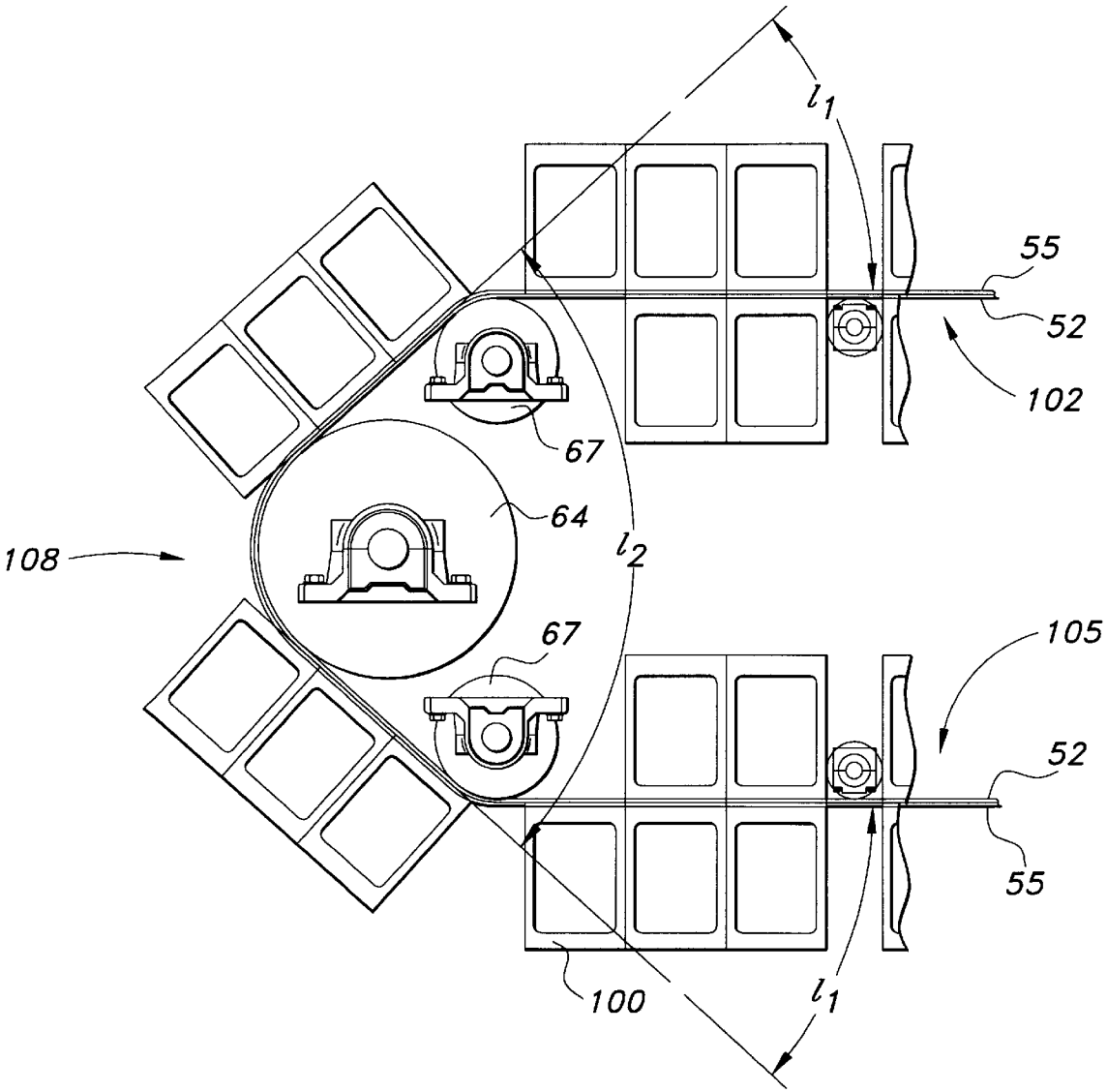
FIG. 2 is a detailed sectional view of the arrangement of the guide rollers in the present invention.

Turning to FIG. 2, the belts 52 and 55 change directions from a first rectilinear section 102 to a second rectilinear section 105 by passing around a curvilinear section 108 formed by the first guide member 64 and the second guide members 67. The first guide member 64 is disposed between the smaller second guide members 67 such that the belts 52 and 55 make a one hundred eighty degree turn. The first guide member is preferably 457 mm in diameter, and the second guide members are preferably 219 mm in diameter. The center to center distance between the rollers is preferably approximately 385 mm. The second guide member 67 preferably deflects the belt at an angle $l_1$ of approximately 45 to 50 degrees, and the angle $l_2$ formed by the belts about both sides of the first guide member is approximately 80 to 90 degrees.

This combination of guide members 64 and 67 provides for connecting rectilinear sections to maximize the use of the drying space and provides a gradual turn that enables smaller diameter guide members to be used to accomplish a one hundred eighty degree turn. The size and positioning of the guide members 64 and 67 facilitates a smooth turn without cracking of the veneer yet provides enough pressure on the veneer to provide a smoothing effect.

In operation, the sheets of veneer are sliced and then fed into the intake zone 28 by a separate conveyor or other material handling means. The sheets are picked up by the nip of the belts 52 and 55 and carried up into the first rectilinear section 111 positioned at the top of the drying chamber 10. This first pass is preferably positioned at the top of the drying chamber 10 to allow for the best use of ventilation and to ensure the rapid evaporation of the free water. The sheet of veneer is carried along the drying path first through an "S" shaped section 114 through the first three zones 13, 16, and 19. The "S" shaped section 114 provides two curvilinear sections and three rectilinear sections to maximize the resident time in these zones. After the veneer passes through the "S" shaped section, it enters an "anvil" shaped section 117 where it passes through the zones 22 and 25 along a path resembling an anvil shape. Upon exiting zone 25, the veneer passes to another conveying system inside the cooling zone 34. At this point the belts 52 and 55 separate and return to the intake zone 28 along separate paths of rollers 79.

Disposed along the entire length of the drying path, jet boxes 100 contain nozzles 94 for providing drying air to the sheets as they pass through the system. The nozzles 94 are preferably disposed equidistant to the sheets at all points in the drying path in order to promote uniform drying.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A drying apparatus for drying sheets of sliced veneer, comprising:

a drying chamber having a plurality of modular sections, each of the plurality of modular sections having a ventilator and a heat exchanger;

an exhaust port connected to the drying chamber;

a plurality of guide members disposed inside the drying chamber, the guide members disposed to form rectilinear and curvilinear sections, the curvilinear sections having a first guide member disposed between two second guide members, the second guide members being smaller in diameter than the first guide member, the guide members defining a drying path, the drying path having an initial rectilinear section disposed at the top of the drying chamber;

at least two endless belts engaged with the guide members and juxtaposed together when the sheets are moving along the drying path, the endless belts disposed over the guide members and capable of carrying the sheets of veneer between the at least two belts, the juxtaposed belts being deflected about the second guide members at an angle of approximately 45 to 50 degrees the angle between the juxtaposed belts on one side of the first guide member and the juxtaposed belts on the other side of the first guide member being approximately 80 to 90 degrees;

means for driving the belts around the drying path; and a plurality of jet boxes having nozzles, the nozzles disposed around the drying path equidistant from the sheets of sliced veneer.

* * * * *